United States Patent [19]

Purser

[11] Patent Number: 4,818,005

[45] Date of Patent: Apr. 4, 1989

[54] GRAPPLE WITH POWERED TOP AND BOTTOM JAW

[75] Inventor: Brian Purser, Stoke-on-Trent, United Kingdom

[73] Assignee: Dudley Shearing Machine Mauf. Co. Limited, Stoke-on-Trent, England

[21] Appl. No.: 69,693

[22] Filed: Jul. 2, 1987

[51] Int. Cl.[4] ..... B66C 3/16

[52] U.S. Cl. ..... 294/88; 294/107; 294/115; 414/739

[58] Field of Search ..... 294/68.23, 88, 104–107, 294/115; 37/184, 186, 188, DIG. 3, DIG. 9, DIG. 12, 117.5; 414/729, 738, 739, 912, 920

[56] References Cited

U.S. PATENT DOCUMENTS

| | | | |
|---|---|---|---|
| 1,773,478 | 8/1930 | Dovel | 414/739 |
| 3,802,731 | 4/1974 | La Bounty | 294/88 |
| 4,131,210 | 12/1978 | Everson | 294/104 X |
| 4,268,217 | 5/1981 | Perreault et al. | 294/88 X |
| 4,283,866 | 8/1981 | Ogawa | 37/117.5 |
| 4,413,945 | 11/1983 | La Bounty | 414/739 |
| 4,519,739 | 5/1985 | Risch | 414/739 X |
| 4,635,386 | 1/1987 | Kobayasi | 414/739 X |

FOREIGN PATENT DOCUMENTS

| | | | |
|---|---|---|---|
| 2628496 | 3/1977 | Fed. Rep. of Germany | 294/107 |
| 85035 | 7/1981 | Japan | 37/DIG. 12 |
| 293941 | 3/1971 | U.S.S.R. | 37/117.5 |

*Primary Examiner*—Johnny D. Cherry

*Attorney, Agent, or Firm*—W. Thad Adams, III

[57] ABSTRACT

A grapple with a mounting bracket for attachment to the outer boom of an excavator having a hydraulic cylinder with a top jaw mounted for pivotal movement on the mounting bracket. A bottom jaw is attached to the mounting bracket for opening and closing cooperation with the top jaw. Linkages are connected, respectively, to the top and bottom jaws and to the hydraulic cylinder for unison powered movement of the top and bottom jaws into an open position, and for unison powered movement of the top and bottom jaws into a closed position by operation of only the single hydraulic cylinder through the linkage. The top jaw and the bottom jaw are coaxially mounted on the mounting bracket. The linkages include a top linkage bar connected by one end to the top jaw and a bottom linkage bar connected by one end to the bottom jaw. The other end of both top and bottom linkage bars are attached to the hydraulic cylinder through a hydraulic cylinder linkage bar.

4 Claims, 2 Drawing Sheets

GRAPPLE WITH POWERED TOP AND BOTTOM JAW

TECHNICAL FIELD AND BACKGROUND OF THE INVENTION

This invention relates to a grapple with a powered top and bottom jaw. The grapple is intended specifically to be mounted in place of a bucket on the end of the boom of a backhoe or excavator. The grapple makes use of the piston and cylinder of the excavator to operate the grapple, thus providing a very economical unit which nevertheless functions better than equivalent prior art units. Two basic types of prior art grapples are known. In one type, one of the top or bottom jaws is held in fixed relation and is now powered. The other jaw is powered by a hydraulic cylinder and moves relative to the other jaw to perform the grappling function. In the other type, each of the jaws is powered by a separate hydraulic cylinder. This requires that the grapple attachment itself have hydraulic cylinders since the single hydraulic cylinder on the boom of the excavator is insufficient to power all of the jaws.

This invention permits both jaws to be powered, while using the single hydraulic cylinder provided on the excavator.

SUMMARY OF THE INVENTION

Therefore, it is an object of the invention to provide a grapple having powered top and bottom jaws.

It is another object of the invention to provide a grapple which makes use of the hydraulic cylinder on the boom of the excavator to power both the top and bottom jaws of a grapple attachment.

It is another object of the invention to provide a grapple attachment which does not require its own hydraulic cylinder.

These and other objects of the present invention are achieved in the preferred embodiments disclosed below by providing a grapple comprising a mounting bracket for attachment to the dipper arm of an excavator having a hydraulic cylinder with a top jaw mounted for pivotal movement on the mounting bracket. A bottom jaw is attached to the mounting bracket for opening and closing cooperation with the top jaw. Linkage means are connected, respectively, to the top and bottom jaws and to the hydraulic cylinder for unison powered movement of the top and bottom jaws into an open position, and for unison powered movement of the top and bottom jaws into a closed position by operation of only the single hydraulic cylinder through the linkage means.

According to one preferred embodiment of the invention, the top jaw and the bottom jaw are coaxially mounted on the mounting bracket.

According to another preferred embodiment of the invention, the linkage means comprises a top linkage bar connected by one end thereof to the top jaw, a bottom linkage bar connected by one end thereof to the bottom jaw, and wherein the other end of both top and bottom linkage bars are attached to the hydraulic cylinder through a hydraulic cylinder linkage bar.

According to yet another embodiment of the invention, the linkage means includes means for moving the top and bottom jaws different distances for the same movement of the hydraulic cylinder.

Preferably, the linkage means comprises a top linkage bar connected by one end thereof to the top jaw, a bottom linkage bar connected by one end thereof to the bottom jaw, and wherein the other end of both top and bottom linkage bars are attached to the hydraulic cylinder through a hydraulic cylinder linkage bar.

According to one preferred embodiment of the invention, the top linkage bar is longer than the bottom linkage bar for moving the top jaw a greater distance than the bottom jaw.

According to another preferred embodiment of the invention, the bottom linkage bar is longer than the top linkage bar for moving the bottom jaw a greater distance than the top jaw.

BRIEF DESCRIPTION OF THE DRAWINGS

Some of the objects of the invention have been set forth above. Other objects and advantages of the invention will appear as the description of the invention proceeds when taken in conjunction with the following drawings, in which.

DESCRIPTION OF THE PREFERRED EMBODIMENT

Figure 1:
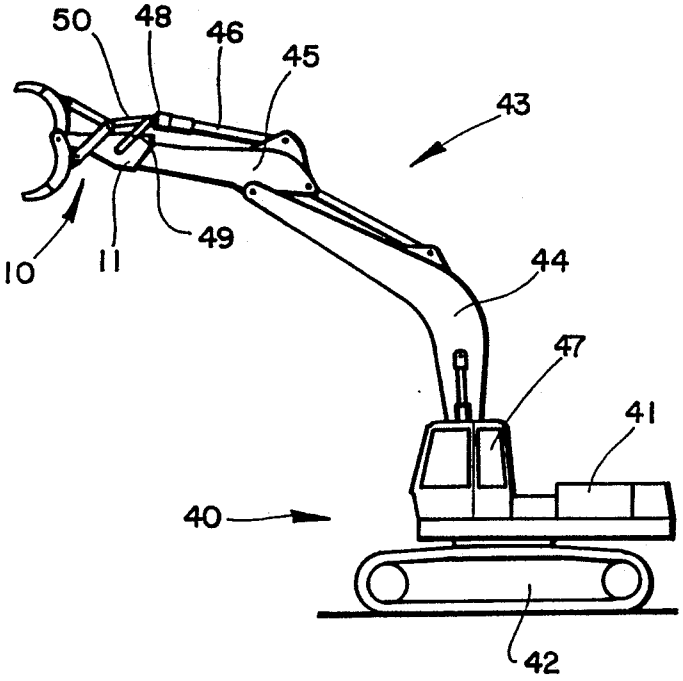
FIG. 1 is a side elevation view of an excavator with a grapple according to the present invention mounted thereon.

Referring now specifically to the drawings, a grapple according to the present invention is illustrated in FIG. 1 and shown generally at reference numeral 10. Grapple 10 is shown mounted on an excavator 40 which includes a body 41 having an operator cab 47 mounted on treads 42. A boom 43, comprised of an inner boom portion 44 and an outer boom portion 45 is carried by body 41 and usually carries a bucket (not shown). In the embodiment shown in FIG. 1, the excavator 40 includes a hydraulic cylinder 46 which includes a piston (not shown) and a piston rod 48. A pivoting bucket lever 49 and a pivotally-mounted bucket arm 50 are attached to the free end of the piston arm 48. Grapple 10 may be mounted by a connection bracket 11 onto the end of boom segment 45 by welding or by heavy bolts.

Figure 2:
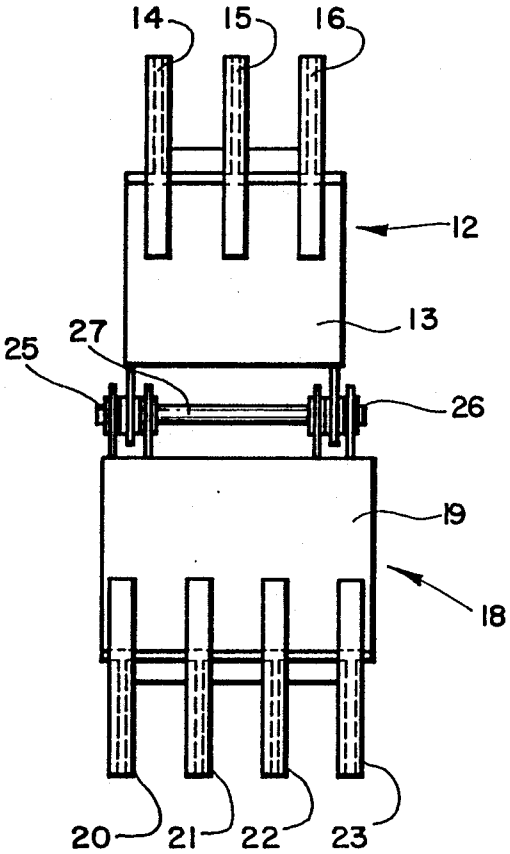
FIG. 2 is a front view of the grapple in its open position.

Referring now to FIG. 2, grapple 10 comprises a top jaw 12 including a top jaw plate 13 which carries three outwardly-extending grappling fingers 14, 15, 16, and a bottom jaw 18 comprised of a bottom jaw plate 19 which carries four spaced-apart fingers 20, 21, 22, 23. Of course the number of fingers is variable as the provision of a different or like number of fingers on the top and bottom jaws, respectively.

Top and bottom jaws 12 and 18 are connected together by hinge assemblies 25, 26 mounted on a common axle 27.

Figure 3:
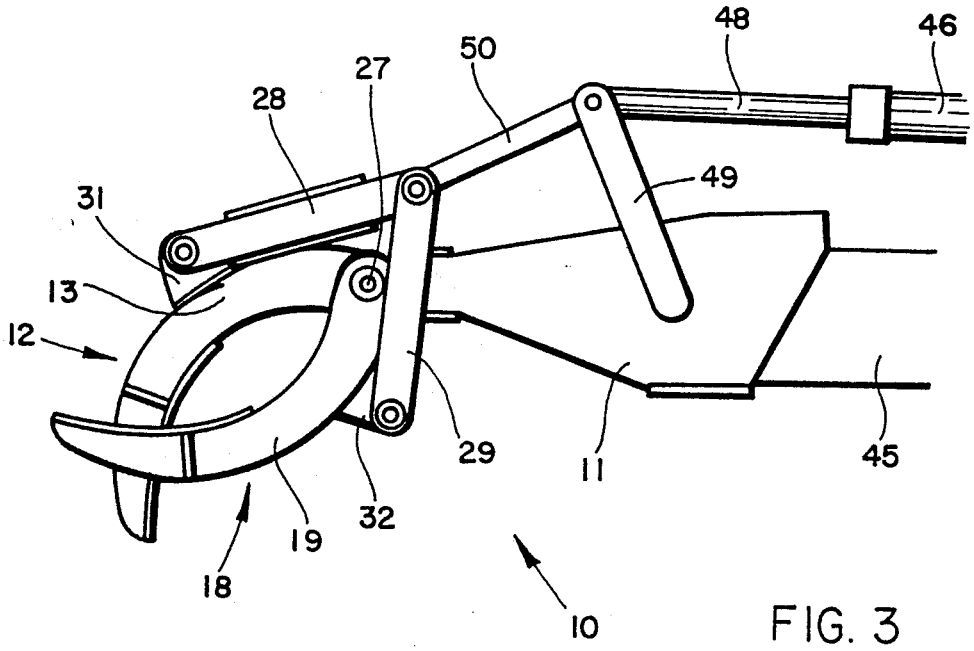
FIG. 3 is a side elevation view of the grapple in its closed position.
Figure 4:
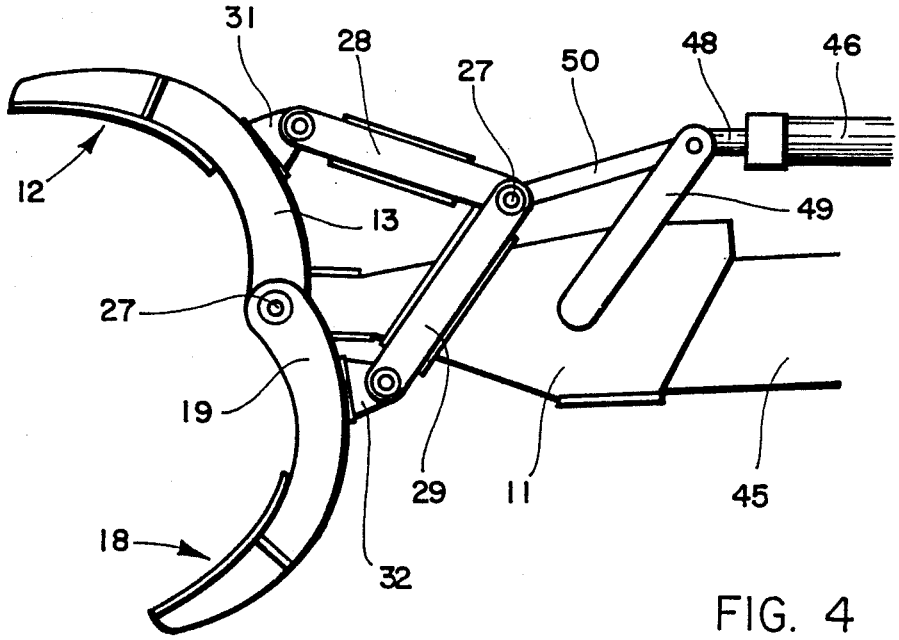
FIG. 4 is a side elevation view of the grapple in its open position.

Referring now to FIGS. 3 and 4, a top linkage bar 28 and a bottom linkage bar 29 are coaxially and pivotally mounted on one end of the bucket arm 50. The other ends of the top linkage bar 28 and bottom linkage bar 29, respectively, are pivotally mounted to mounting brackets 31, 32, which are in turn affixed to the top jaw plate 13 and the bottom jaw plate 19.

With piston arm 48 extended, as is shown in FIG. 3, top and bottom jaws 12 and 18 are closed with the fingers in interlocking relation. With the piston arm 48 in its retracted position, jaws 12 and 18 are open. The degree of closure is easily controlled by operation of the hydraulic cylinder 46 from the cab of the excavator.

The length of the top linkage bar 28 and bottom linkage bar 29 can be the same, as is shown in the drawings, or different. If the bottom linkage bar 29 is longer, the bottom jaw 18 will move slower and therefore less distance, and vice versa.

A grapple with powered top and bottom jaws is described above. Various details of the invention may be changed without departing from its scope. Furthermore, the foregoing description of the preferred embodiment according to the present invention is provided for the purpose of illustration only and not for the purpose of limitation—the invention being defined by the claims.

I claim:

1. A grapple, comprising:

(a) a mounting bracket for attachment to an outer boom of an excavator having a hydraulic cylinder mounted thereon;

(b) a top jaw having an inner end and an outer, free end, said top jaw mounted by its inner end for pivotal movement on said mounting bracket;

(c) a bottom jaw having an inner end and an outer, free end, said bottom jaw mounted by its inner end for pivotal movement on said mounting bracket for opening and closing cooperation with said top jaw; and (d) linkage means connected, respectively, to said top and bottom jaws intermediate said inner and outer ends thereof and to said hydraulic cylinder for unison powered movement of said top and bottom jaws into an open position, and for unison powered movement of said top and bottom jaws into a closed position by operation of only the single hydraulic cylinder through said linkage means, said linkage means comprising a bucket lever pivoted by pivots at opposite ends thereof to a piston rod means of said cylinder and said outer boom, and a bottom linkage arm pivoted by pivots at opposite ends to said bottom jaw and a top linkage bar means interconnecting said piston rod means and said top jaw, wherein the two pivots of the bucket lever are at all times positioned between the two pivots of the bottom linkage arm and said piston rod means.

2. A grapple according to claim 1, wherein said top jaw and said bottom jaw are coaxially mounted on said mounting bracket.

3. A grapple according to claim 1, wherein said top jaw and said bottom jaw each comprise at least three separate spaced-apart grappling fingers mounted on a common axis.

4. A grapple according to claim 3, wherein the grappling fingers of the top are mounted in laterally offset relation to the grappling fingers of the bottom jaw for permitting the top jaw and the bottom jaw to move past each other into an interlocking position.

* * * * *